US005304016A

United States Patent [19]

Kunito

[11] Patent Number: 5,304,016

[45] Date of Patent: Apr. 19, 1994

[54] METHOD FOR FORMING A PILLAR IN AN EARTHEN FOUNDATION

[75] Inventor: Mitsuhiro Kunito, Kishiwada, Japan

[73] Assignee: Kabushiki Kaisha Ask Kenkyusho, Osaka, Japan

[21] Appl. No.: 14,166

[22] Filed: Feb. 5, 1993

[30] Foreign Application Priority Data

Nov. 10, 1992 [JP] Japan ..... 4-299558

[51] Int. Cl.[5] ..... E02D 5/46; E02D 3/12

[52] U.S. Cl. ..... 405/233; 405/240; 405/266; 405/269

[58] Field of Search ..... 405/233, 236, 240, 241, 405/263, 266, 267, 269

[56] References Cited

U.S. PATENT DOCUMENTS 4,212,565 7/1980 Watabe ..... 405/269
4,566,825 1/1986 Hirai et al. ..... 405/267
4,659,259 4/1987 Reed et al. ..... 405/263

FOREIGN PATENT DOCUMENTS 59-16049 4/1984 Japan .

*Primary Examiner*—David H. Corbin
*Attorney, Agent, or Firm*—Armstrong, Westerman, Hattori, McLeland & Naughton

[57] ABSTRACT

For constructing a pillar in an earthen foundation, a consolidating fluid is sprayed inside the earthen foundation from consolidating fluid spray nozzles provided on a rotating shaft, and then the consolidating fluid and the soil of the original foundation are stirred and mixed. The consolidating fluid spray nozzles which spray the consolidating fluid approximately horizontally are provided on the rotating shaft. The pillar is formed in the earthen foundation by stirring and mixing together the consolidating fluid and the soil of the original foundation in such a way that the rotating speed of the rotating shaft is faster for clayish soil than for sandy soil, the pressure from the consolidating fluid spray nozzles is higher for clayish soil than for sandy soil, and the penetration speed of the rotating shaft is slower for clayish soil than for sandy soil. Consequently, it makes possible to form in the earthen foundation a high-quality foundation-improvement pillar by the most efficient method with respect to differences in the soil.

11 Claims, 14 Drawing Sheets

METHOD FOR FORMING A PILLAR IN AN EARTHEN FOUNDATION

BACKGROUND OF THE INVENTION

1. Field of the Invention

This invention relates to a method for forming earth retaining walls, cut-off walls, and foundation piles in an earthen foundation or for forming a pillar in an earthen foundation for the purpose of foundation improvement.

2. Description of the Prior Art

In the past, a method for forming a pillar in an earthen foundation in which consolidating fluid spray nozzles which spray consolidating fluid horizontally are provided on an excavating shaft, consolidating fluid is sprayed horizontally from the consolidating fluid spray nozzles while excavating is executed by the excavating shaft, and the consolidating fluid and the soil of the original earthen foundation are stirred and mixed together was disclosed in Japanese Patent Publication [KOKOKU] No. 59-16049. In addition, a method for forming a pillar in an earthen foundation is also known in which an excavating shaft is positioned inside a casing tube, consolidating fluid spray nozzles which spray consolidating fluid horizontally are provided on said excavating shaft, the earthen foundation is excavated by the bit at the tip of the excavating shaft inside the casing tube, consolidating fluid is sprayed horizontally from the consolidating fluid spray nozzles, and the consolidating fluid and the soil of the original earthen foundation are stirred and mixed together inside the casing tube. In these examples of the prior art, because the consolidating fluid sprayed from the consolidating spray nozzles provided on the excavating shaft and the soil of the original earthen foundation are stirred and mixed together while the consolidating fluid is being sprayed horizontally, in addition to the soil of the original foundation being finely sheared by the consolidating fluid which is being sprayed horizontally, the consolidating fluid which is being sprayed horizontally revolves as a result of the rotation of the rotating shaft, and thus the finely sheared soil of the original foundation and the consolidation fluid are stirred and mixed together.

However, with either of the examples of the prior art described above, the rotating speed of the excavating shaft, the spray pressure from the consolidating fluid spray nozzles, and the penetration speed of the rotating shaft were set at fixed values regardless of the characteristics of the soil, such as clayish soil, sandy soil, etc. Because of this, such problems existed as differences in the soil causing the strength of the pillar formed in the foundation to be inconsistent, it not being possible to achieve high-quality foundation improvement, which is the objective, the consolidating fluid being supplied in greater amounts than needed, or excessive work time being required.

In addition, with a method in which the consolidating fluid is sprayed horizontally, although the method has the characteristics described above, because the stirring and mixing are accomplished within the range in which the consolidating fluid is sprayed while revolving, the stirring and mixing range for one rotation of the rotating shaft is an approximately circular shape, and in consideration of the viewpoint of achieving efficient stirring and mixing in accordance with the conditions of the earthen foundation and at such times as when the excavating shaft is ascending or descending, in some situations, horizontal spraying, or horizontal spaying alone, is not sufficient.

In consideration of the problems of the prior art described above, this invention proposes a method for forming a pillar in an earthen foundation, the first objective of which is to make it possible to form in an earthen foundation a high-quality foundation-improvement pillar by the most efficient method with respect to differences in the soil, and, in addition, the second objective of which is to make it possible to achieve the most efficient stirring and mixing together of the soil of the original foundation and the consolidating fluid in accordance with the conditions of the earthen foundation and the descent and ascent of the excavating shaft.

SUMMARY OF THE INVENTION

In order to solve the problems of the examples of the prior art described above and achieve the stated objectives of the invention, this invention is a method for forming a pillar 5 in an earthen foundation 4 by spraying, inside the earthen foundation 4, consolidating fluid 3 from consolidating fluid spray nozzles 2 provided on a rotating shaft 1 and stirring and mixing together the consolidating fluid 3 and the soil of the original foundation, characterized in that consolidating fluid spray nozzles 2 which spray the consolidating fluid 3 approximately horizontally are provided on the rotating shaft 1, and the pillar 5 is formed in the earthen foundation 4 by stirring and mixing together the consolidating fluid 3 and the soil of the original foundation in such a way that the rotating speed of the rotating shaft 1 is faster for clayish soil than for sandy soil, the pressure from the consolidating fluid spray nozzles 2 is higher for clayish soil than for sandy soil, and the penetration speed of the rotating shaft 1 is slower for clayish soil than for sandy soil.

In addition, it is also possible to provide on the rotating shaft 1 consolidating fluid spray nozzles 2 which spray consolidating fluid 3 diagonally downward.

In addition, it is also possible to provide on the rotating shaft 1 consolidating fluid spray nozzles 2 which spray consolidating fluid 3 diagonally upward.

In addition, it is also possible to provide on the rotating shaft 1 consolidating fluid spray nozzles 2 which spray consolidating fluid 3 diagonally downward, consolidating fluid spray nozzles 2 which spray consolidating fluid 3 approximately horizontally, and consolidating fluid spray nozzles 2 which spray consolidating fluid 3 diagonally upward. Also, in this case, it is preferable that it be possible to individually select the spray of consolidating fluid 3 from each of the consolidating fluid spray nozzles 2.

In addition, it is also possible to provide stirring components 6 on the rotating shaft 1.

In addition, it is also possible to position the rotating shaft 1 inside a casing tube 7 so that the soil of the original foundation and the consolidating fluid 3 are stirred and mixed together inside said casing tube 7.

Furthermore, it is preferable for the rotating speed of the rotating shaft 1 to be set to approximately 40 to 70 revolutions per minute for clayish soil and to approximately 25 to 40 revolutions per minute for sandy soil, for the spray pressure from the consolidating fluid spray nozzles 2 to be set to approximately 100 to 500 $kg/cm^2$ for clayish soil and to approximately 50 to 100 $kg/cm^2$ for sandy soil, and for the penetration speed of the rotating shaft 1 to be set to approximately 1 meter per minute for clayish soil and to approximately 2 meters per minute for clayish soil.

With the invention having the composition described above, although consolidating fluid 3 is sprayed from consolidating fluid spray nozzles 2 provided on a rotating shaft 1 and the pillar 5 is formed in the earthen foundation 4 by stirring and mixing together the consolidating fluid 3 and the soil of the original foundation, the stirring and mixing are accomplished by the consolidating fluid 3 which is being sprayed approximately horizontally from the consolidating fluid spray nozzles 2 provided on the rotating shaft 1 and which finely shears the soil of the original foundation, and, in addition, the pillar 5 is formed in the earthen foundation 4 by the stirring and mixing together of the consolidating fluid 3 and the soil of the original foundation in such a way that the rotating speed of the rotating shaft 1 is faster for clayish soil than for sandy soil, the pressure from the consolidating fluid spray nozzles 2 is higher for clayish soil than for sandy soil, and the penetration speed of the rotating shaft 1 is slower for clayish soil than for sandy soil.

Incidentally, soil can be generally classified into either clayish soil or sandy soil. Because clayish soil has smaller soil particles than sandy soil and the resistance during rotation (especially the resistance when stirring components 6 are provided on the rotating shaft 1) is less, high-speed rotation at a higher number of revolutions per minute than for sandy soil provides efficient stirring and mixing with no breakage of the rotating shaft 1 or of the stirring components 6 as a result of metal fatigue. In addition, by using a higher spray pressure from the consolidating fluid spray nozzles 2 for clayish soil than for sandy soil, in spite of the fact that the clayish soil is denser, with less space between the soil particles, the high spray pressure makes it possible for the consolidating fluid to pass through between the soil particles and achieve efficient fine shearing, and also stirring and mixing, of the clayish soil. With sandy soil, because the space between the soil particles is large, the consolidating fluid is able to pass through between the soil particles at low spray pressure and achieve efficient fine shearing, and also stirring and mixing, of the sandy soil. Furthermore, with sandy soil, although the amount of consolidating fluid which is sprayed is less than for clayish soil because the spray pressure is lower, because sandy soil has larger soil particles than clayish soil, the amount of consolidating fluid required to join together the soil particles per unit of volume is relatively less, and thus there is no danger of more consolidating fluid than needed being supplied. In addition, because sandy soil has larger soil particles and because it separates and breaks apart easily, the penetration speed of the rotating shaft 1 (the foundation improvement speed) is increased, and because clayish soil has smaller soil particles and is more difficult to separate, the penetration speed of the rotating shaft 1 is decreased, thus providing high-quality foundation improvement.

In addition, when consolidating fluid spray nozzles 2 which spray consolidating fluid 3 diagonally downward are provided on the rotating shaft 1, by spraying the consolidating fluid 3 diagonally downward while rotating the rotating shaft 1, the stirring and mixing range for one rotation of the rotating shaft becomes an approximately conical shape, thus enlarging the stirring and mixing range. In particular, by stirring and mixing while spraying diagonally downward during the descent of the rotating shaft 1, this approximately conically shaped stirring and mixing range overlaps as it moves downward, thus making possible efficient stirring and mixing.

Furthermore, when consolidating fluid spray nozzles 2 which spray consolidating fluid 3 diagonally upward are provided on the rotating shaft 1, by spraying the consolidating fluid 3 diagonally downward while rotating the rotating shaft 1, the stirring and mixing range for one rotation of the rotating shaft becomes an approximately upside-down conical shape, thus enlarging the stirring and mixing range. In particular, by stirring and mixing while spraying diagonally upward during the ascent of the rotating shaft 1, this approximately upside-down conically shaped stirring and mixing range overlaps as it moves upward, thus making possible efficient stirring and mixing.

In addition, when consolidating fluid spray nozzles 2 which spray consolidating fluid 3 diagonally downward, consolidating fluid spray nozzles 2 which spray consolidating fluid 3 approximately horizontally, and consolidating fluid spray nozzles 2 which spray consolidating fluid 3 diagonally upward are provided on the rotating shaft 1, it is possible to select the spray direction of the consolidating fluid 3 in accordance with the type of soil and the descent and ascent of the rotating shaft, thus providing the most efficient stirring and mixing.

In addition, when stirring components 6 are provided on the rotating shaft 1, the stirring and mixing together of the soil of the original foundation and the consolidating fluid sprayed from the consolidating fluid spray nozzles 2 are accomplished more efficiently.

In addition, when the rotating shaft 1 is positioned inside a casing tube and the stirring and mixing together of the soil of the original foundation and the consolidating fluid 3 are accomplished inside the casing tube 7, a pillar having the same diameter as the casing tube 7 can be formed without the surrounding earthen foundation being damaged by the spraying of the consolidating fluid 3, and, in addition, because the consolidating fluid 3 sprayed from the consolidating fluid spray nozzles 2, together with the soil of the original foundation, strikes forcefully against the inner wall of the casing tube 7, an even finer level of shearing is accomplished.

Furthermore, by setting the rotating speed of the rotating shaft 1 to approximately 40 to 70 revolutions per minute for clayish soil and to approximately 25 to 40 revolutions per minute for sandy soil, the spray pressure from the consolidating fluid spray nozzles 2 to approximately 100 to 500 kg/cm$^2$ for clayish soil and to approximately 50 to 100 kg/cm$^2$ for sandy soil, and the penetration speed of the rotating shaft 1 to approximately 1 meter per minute for clayish soil and to approximately 2 meters per minute for clayish soil, it becomes possible to perform efficient stirring and mixing in accordance with the conditions of the foundation.

DESCRIPTION OF THE PREFERRED EMBODIMENTS

The following is an explanation of the invention based on the embodiments shown in the accompanying drawings.

Figure 2:
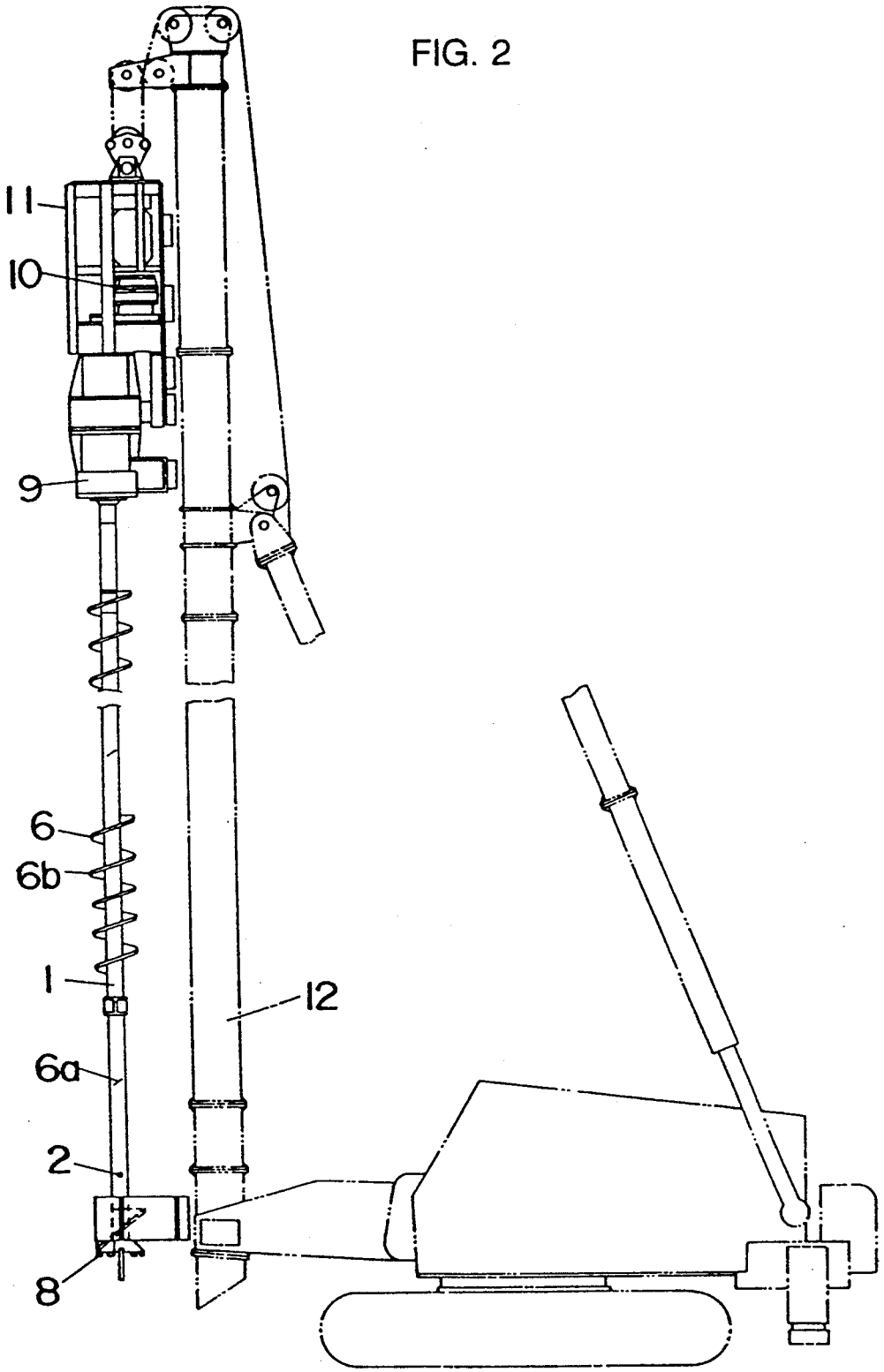
FIG. 2 is partially cutaway overall frontal view of the device used in the embodiment shown in FIG. 1.
Figure 3:
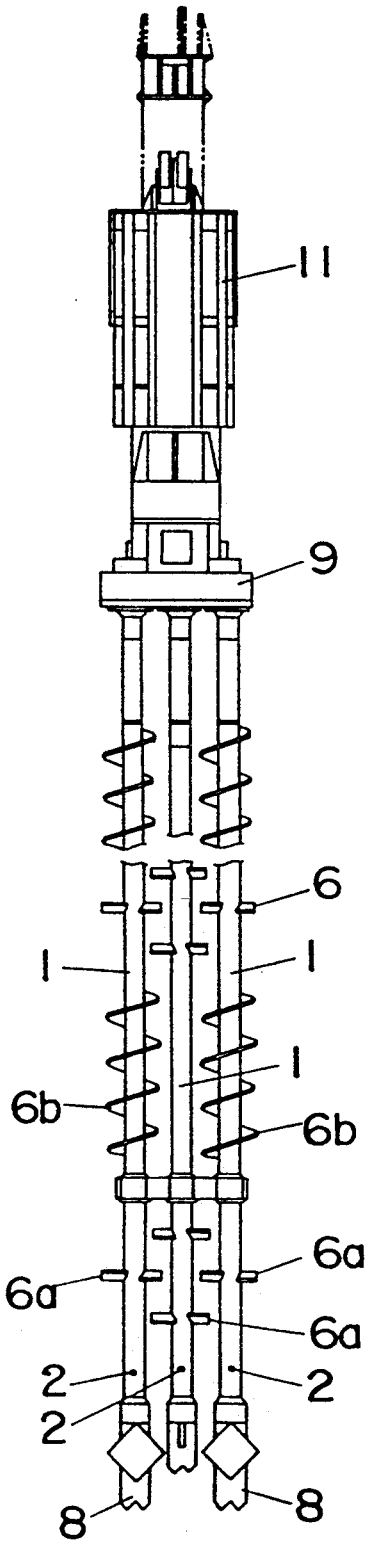
FIG. 3 is partially cutaway overall side view of the device used in the embodiment shown in FIG. 1.
Figure 4:
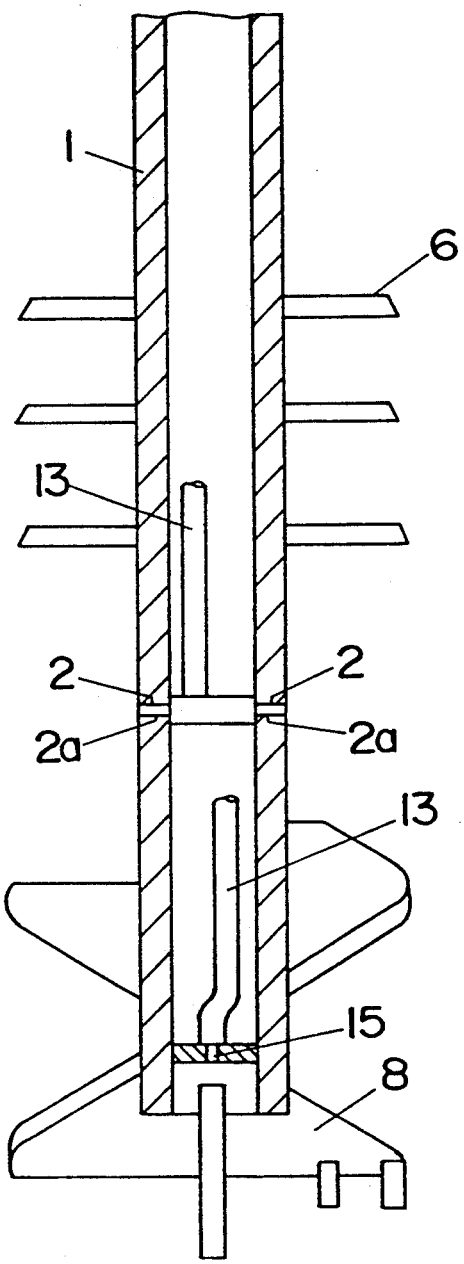
FIG. 4 is an enlarged cross-sectional view of the major components of the device used in the embodiment shown in FIG. 1.
Figure 5:
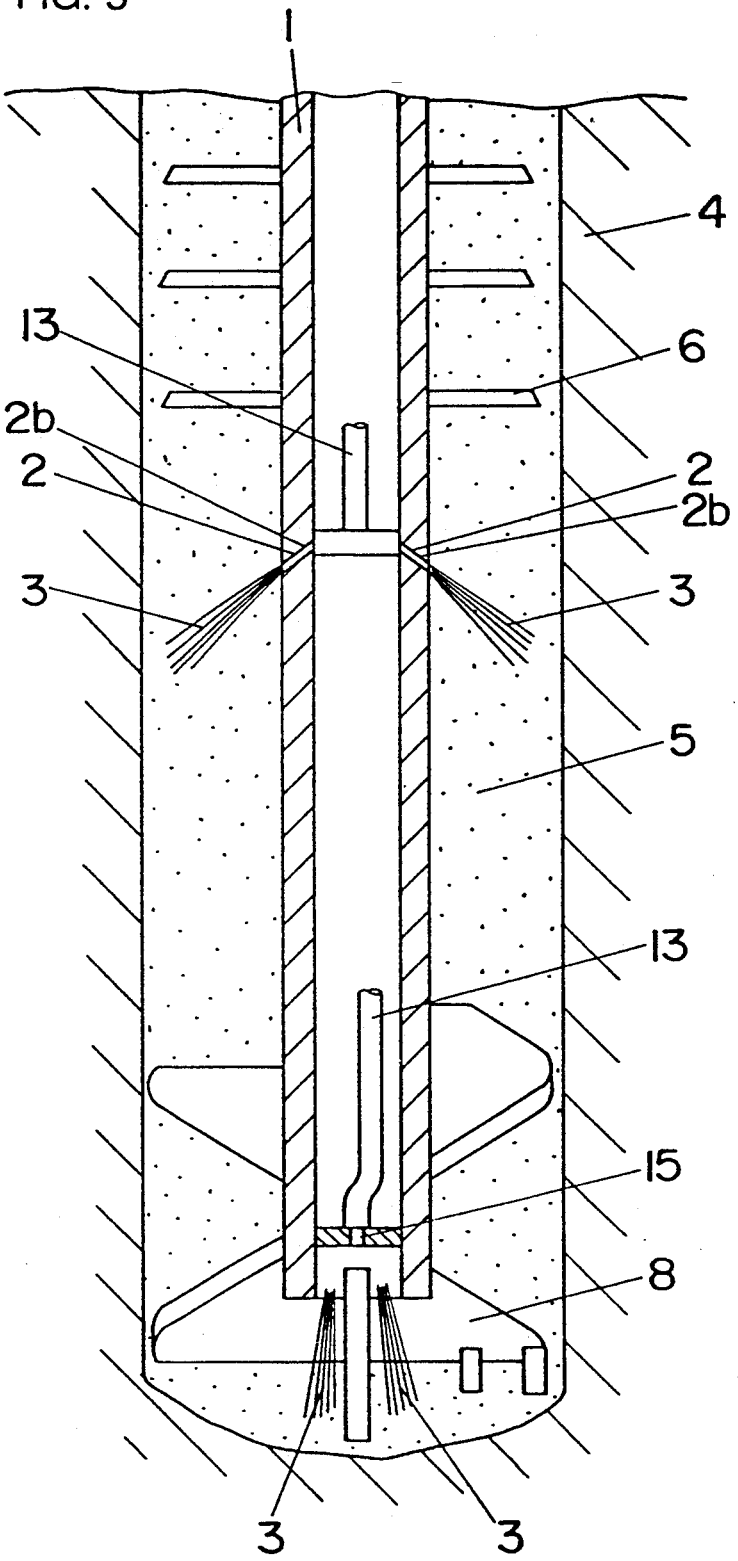
FIG. 5 is a cross-sectional view of the work-in-progress condition of another embodiment of this invention.
Figure 6:
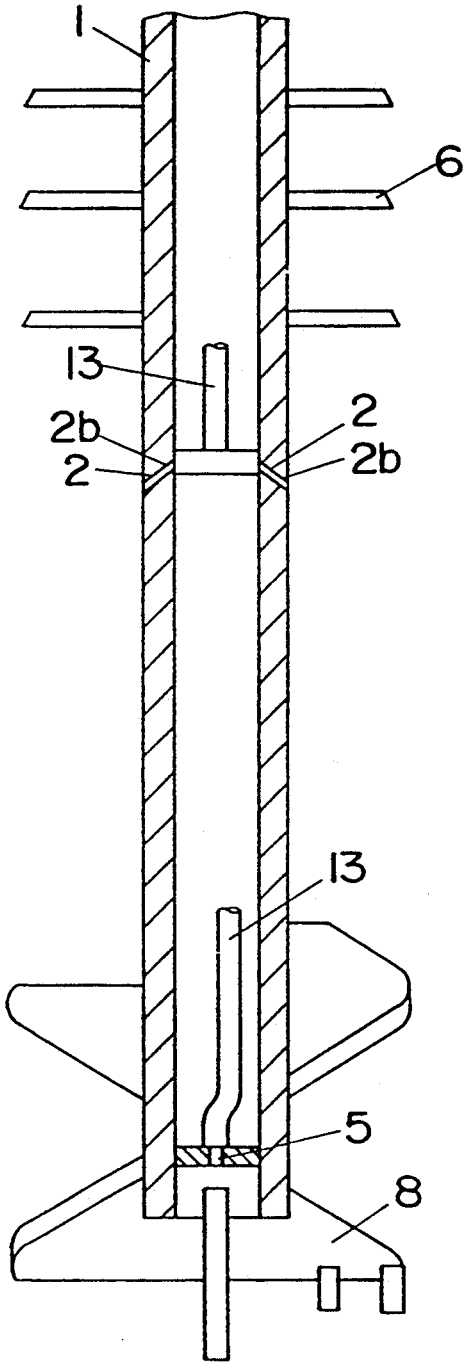
FIG. 6 is an enlarged cross-sectional view of the major components of the device used in embodiment shown in FIG. 5.

FIGS. 2, 3, and 4, show one example of the device used in the method of this invention. In the embodiment of this device shown in the drawings, a bit 8 is provided on the bottom of a rotating shaft 1. On this bit 8 is provided a downward port 15 for spraying downward consolidating fluid 3 comprised of cement milk, a fluid mixture the main ingredient of which is cement milk, or some other chemical fluid. At positions above the bit 8 on the bottom of the rotating shaft 1 are provided consolidating fluid spray nozzles 2 for spraying consolidating fluid 3 comprised of cement milk, a fluid mixture the main ingredient of which is cement milk, or some other chemical fluid. In the embodiment in FIG. 4, the consolidating fluid spray nozzles 2 are comprised of consolidating fluid spray nozzles 2*a* for spraying consolidating fluid 3 approximately horizontally. In addition, although in this embodiment stirring components 6 such as stirring blades 6*a* or screws 6*b* are provided on the rotating shaft 1 at positions above the consolidating fluid spray nozzles 2, it is also possible to use a simple shaft. In addition, FIG. 3 shows an embodiment in which there are multiple rotating shafts 1. In FIG. 3, 9 is a multiple-shaft device and 10 is a rotating device. By driving the rotating device 10, the multiple rotating shafts 1 are rotated via the multiple-shaft device 9. In addition, a raising/lowering unit 11 is provided on the rotating device 10, and the raising/lowering unit 11 is moved upward and downward via a crawler crane 12. In FIG. 4, 13 is a consolidating fluid supply hose, and the consolidating fluid 3 flows from a consolidating fluid supply device (not shown in the drawings) through the consolidating fluid supply hose 13, and is sprayed from the consolidating fluid spray nozzles 2 and the downward port 15. Also, in this invention, the rotating speed of the rotating shaft 1, which is determined by the control of the rotation of the rotating device 10, the descent speed of the rotating shaft 1, which is determined by the raising/lowering speed of the raising/lowering unit 11, and the spray pressure from the consolidating fluid spray nozzles 2, which is determined by the supply pressure from the consolidating fluid supply device, are all controlled by a control device (not shown in the drawings).

Thus, a pillar 5 is formed in an earthen foundation 4 using a device such as that described above, and the forming of the pillar 5 in the earthen foundation 4 is accomplished as explained below.

Figure 1:
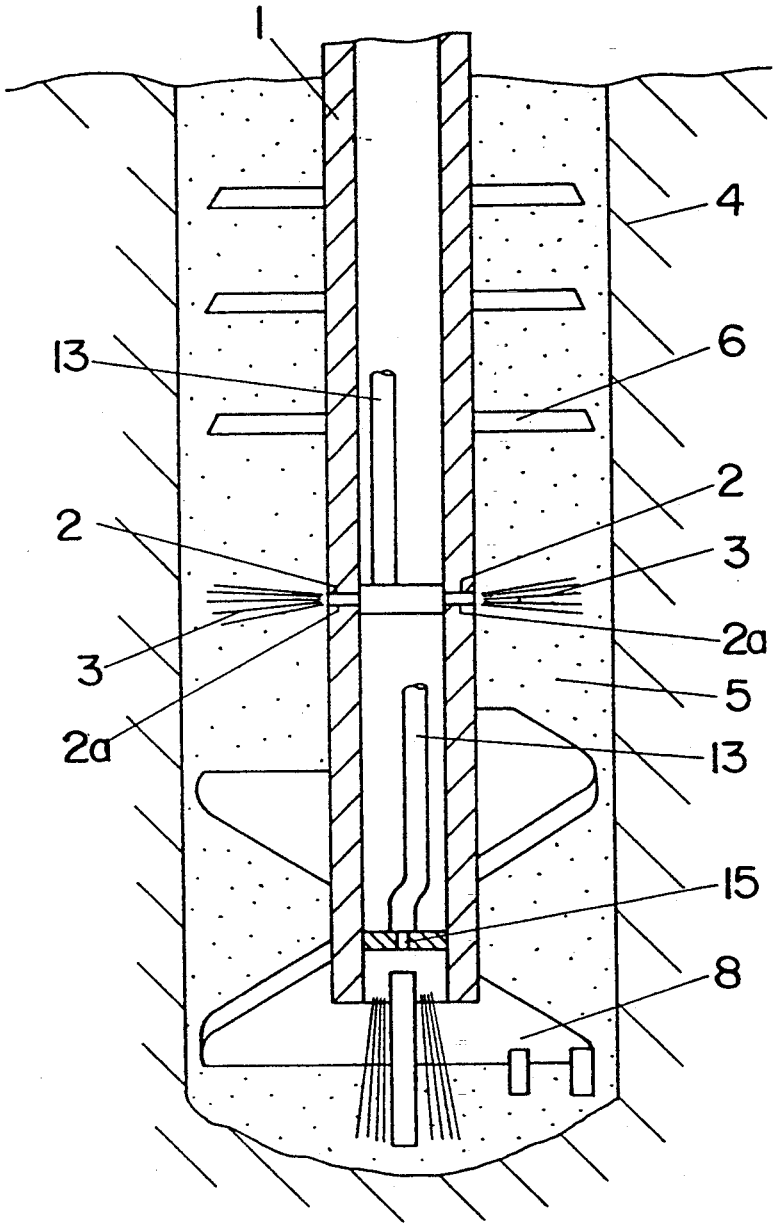
FIG. 1 is a cross-sectional view of the work-in-progress condition of one embodiment of this invention.

The rotating shaft 1 is rotated while consolidating fluid 3 is sprayed downward from the downward port 15 provided in the bit 8, and the earthen foundation 4 is excavated by the bit 8. This consolidating fluid which is sprayed downward from the downward port 15 is stirred and mixed together with the excavated soil of the original foundation. Furthermore, by spraying the consolidating fluid 3 approximately horizontally from the consolidating fluid spray nozzles 2*a* provided on the rotating shaft 1, the excavated soil of the original foundation is finely sheared horizontally, and, in addition, by spraying the consolidating fluid 3 approximately horizontally while the rotating shaft 1 is rotating, the consolidating fluid 3 is sprayed while rotating horizontally, thus causing this finely sheared soil and the consolidating fluid to be stirred and mixed together. In addition, the resulting mixture of consolidating fluid and soil stirred and mixed together in this way is further stirred by the stirring components 6 located higher up on the rotating shaft. FIG. 1 shows a cross-sectional view showing the stirring and mixing condition. Here, the consolidating fluid spray nozzles 2 are not limited to being positioned at the lower part vertically on the rotating shaft 1, but can also be positioned midway and at the upper part in the vertical direction. In addition, the number of consolidating fluid spray nozzles 2 can also be set as desired. When the stirring and mixing have been accomplished while excavating to the target depth in this way, the rotating shaft 1 is then withdrawn from the earthen foundation 4. As the rotating shaft is being withdrawn, it is also possible to continue the stirring and mixing while spraying the consolidating fluid 3 from the consolidating fluid spray nozzles 2*a*. In this way, a pillar 5 comprised of a soil-cement-like mixture of the original foundation soil and the consolidating fluid 3 is formed in the earthen foundation 4. This pillar 5 may be a single pillar, or, by continuously forming multiple pillars 5 by the procedure described above, it is also possible to form an earth retaining wall or a cut-off wall, or to carry out foundation improvement. In addition, it is also possible to embed structural materials such as steel pipe or a steel H beam inside the pillar 5.

Incidentally, this invention is characterized in the fact that, for the forming of a pillar 5 in a earthen foundation 4 by spraying inside the earthen foundation 4 consolidating fluid 3 from consolidating fluid spray nozzles 2 provided on a rotating shaft 1 and stirring and mixing together the consolidating fluid 3 and the soil of the original foundation as described above, the rotating speed of the rotating shaft 1, the spray pressure from the consolidating fluid spray nozzles 2, and the penetration speed of the rotating shaft 1 (the foundation improvement speed) can be changed in accordance with the conditions of the soil of the earthen foundation 4 in which the pillar 5 is being formed. In other words, with this invention, control is performed by a control device so that the rotating speed of the rotating shaft is faster for clayish soil than for sandy soil, the pressure from the consolidating fluid spray nozzles is higher for clayish soil than for sandy soil, and the penetration speed of the rotating shaft is slower for clayish soil than for sandy soil. Specifically, the rotating speed of the rotating shaft is set to approximately 40 to 70 revolutions per minute for clayish soil and to approximately 25 to 40 revolutions per minute for sandy soil, the spray pressure from the consolidating fluid spray nozzles is set to approximately 100 to 500 kg/cm$^2$ for clayish soil and to approximately 50 to 100 kg/cm$^2$ for sandy soil, and the penetration speed of the rotating shaft is set to approximately 1 meter per minute for clayish soil and to approximately 2 meters per minute for clayish soil.

Here, although the rotating speed of the rotating shaft 1 in the prior art was normally set to 15 to approximately 20 revolutions per minute, with this invention, as mentioned above, at approximately 25 to 40 revolutions per minute, the rotating speed for sandy soil is faster than that of the prior art, and furthermore, in clayish soil it is even faster at 40 to 70 revolutions per minute. The reason why the rotating speed of the rotating shaft 1 is changed in this way depending on whether the soil is sandy or clayish is as follows. Because clayish soil has smaller soil particles than sandy soil and the resistance during rotation is less, especially the resistance when stirring components 6 are provided on the rotating shaft 1, high-speed rotation at a higher number of revolutions per minute than for sandy soil provides efficient stirring and mixing with no breakage of the rotating shaft 1 or of the stirring components 6 as a result of metal fatigue. In addition, although it would be possible to increase the rotating speed for sandy soil (approximately 25 revolutions per minute or higher) to a level higher than the rotating speed used in the prior art by using high-strength materials which are less subject to metal fatigue than previous materials for the stirring components 6 and other parts, or by using a high-performance rotating device 10, in consideration of the costs and other factors involved in the materials used to form the stirring components 6 currently being used, and in consideration of the increased weight, size, and cost of such a high-performance rotating device 10, in sandy soil, it is preferable to use a rotating speed no higher than approximately 40 revolutions per minute, within which range it is difficult for metal fatigue to result from the resistance applied to the stirring components 6. If the rotating speed is increased higher than this, because the diameter of the soil particles of sandy soil is large, they will forcefully strike the stirring components 6 during rotation and cause an increase in metal fatigue of the stirring components 6, which is not desirable. In addition, although it is possible to increase the rotating speed to higher than approximately 40 revolutions per minute for clayish soil because the diameter of the soil particles in clayish soil is smaller than that in sandy soil, if the rotating speed is increased to higher than approximately 70 revolutions per minute, it will lead to increased metal fatigue of the stirring components 6, higher material costs, and the need for a larger rotating device, and thus a rotating speed no higher than approximately 70 revolutions per minute is preferable.

In addition, by using a higher spray pressure from the consolidating fluid spray nozzles 2 for clayish soil than for sandy soil, even though clayish soil is denser with less space between the soil particles, the higher spray pressure makes it possible for the consolidating fluid to pass through between the soil particles and effectively finely shear and also stir and mix the clayish soil; however, the reason for using consolidating fluid spray pressures of approximately 100 to 500 kg/cm$^2$ for clayish soil and approximately 50 to 100 kg/cm$^2$ for sandy soil, as described above, is as follows. If the spray pressure was less than approximately 100 kg/cm$^2$ for clayish soil, it would be difficult for the consolidating fluid to pass through between the soil particles of the clayish soil and the fine shearing of the clayish soil would not be sufficient. Also, if the spray pressure was higher than approximately 500 kg/cm$^2$ for clayish soil, more consolidating fluid than necessary would be supplied, and this would not be desirable. Thus, it is preferable that the spray pressure for clayish soil be set to approximately 100 to 500 kg/cm$^2$. In addition, if the spray pressure was approximately 50 kg/cm$^2$ for sandy soil, even though the diameter of the soil particles is large, the consolidating fluid would not sufficiently pass through between the soil particles, and, also, if the spray pressure was approximately 100 kg/cm$^2$, more consolidating fluid than necessary would be supplied. Thus, it is preferable that the spray pressure for sandy soil be set to approximately 50 to 100 kg/cm$^2$.

In addition, because the soil particles are large in sandy soil, they separate and break apart easily, and thus the penetration speed (foundation improvement speed) of the rotating shaft 1 is increased to approximately 2 meters per minute. Because the soil particles are small in clayish soil, they are difficult to separate, and thus the penetration speed of the rotating shaft 1 is reduced to approximately 1 meter per minute. By doing this, it is possible to perform high-quality foundation improvement.

As mentioned above, the rotating speed of the rotating shaft 1, which is determined by the control of the rotation of the rotating device 10, the descent speed of the rotating shaft 1, which is determined by the raising/lowering speed of the raising/lowering unit 11, and the spray pressure from the consolidating fluid spray nozzles 2, which is determined by the supply pressure from the consolidating fluid supply device, are all controlled by a control device. In order to do this, it is preferable that the soil data for various types of earthen foundations 4 be input beforehand, and, further, that the soil conditions of the earthen foundation 4 at the work site be determined beforehand in preparation by boring or some other method, so that the control device 14 will execute this control based on that work site data. It is also possible to determine the conditions of the earthen foundation 4 during the stirring and mixing process while rotating the rotating shaft 1 and transmit this data to the control device 14 in order to automatically execute the control in accordance with the conditions of the soil existing at the various depths in the earthen foundation 4. Of course, it is also possible to use manual operations in order to change the settings for the rotating speed of the rotating shaft 1, which is determined by the control of the rotation of the rotating device 10, the descent speed of the rotating shaft 1, which is determined by the raising/lowering speed of the raising/lowering unit 11, and the spray pressure from the consolidating fluid spray nozzles 2, which is determined by the supply pressure from the consolidating fluid supply device.

Although the explanation given above was for an embodiment in which stirring components 6 are provided on the rotating shaft 1, in some cases stirring components 6 are not provided on the rotating shaft 1. Even if stirring components 6 are not provided on the rotating shaft 1, in the forming of a pillar 5 in a earthen foundation 4 by spraying consolidating fluid 3 from consolidating fluid spray nozzles 2 provided on a rotating shaft 1 and stirring and mixing together the consolidating fluid 3 and the soil of the original foundation, the spraying of the consolidating fluid 3 horizontally from the consolidating fluid spray nozzles **2*a* provided on the rotating shaft 1 causes the excavated soil of the original foundation to be finely sheared horizontally, and, in addition, the spraying of the consolidating fluid 3 horizontally while the rotating shaft 1 is rotating causes the consolidating fluid 3** to be sprayed while rotating horizontally, and thus the finely sheared soil and the consolidating fluid are stirred and mixed together.

Figure 7:
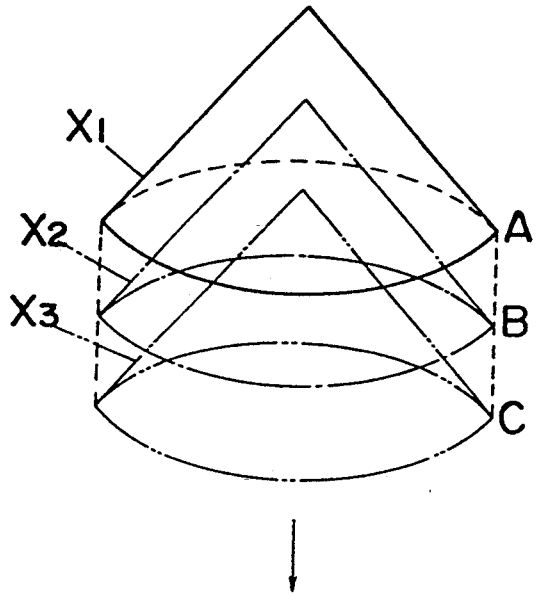
FIG. 7 is an explanatory diagram showing the stirring and mixing range for when the consolidating fluid is sprayed diagonally downward in the embodiment shown in FIG. 5.
Figure 8:
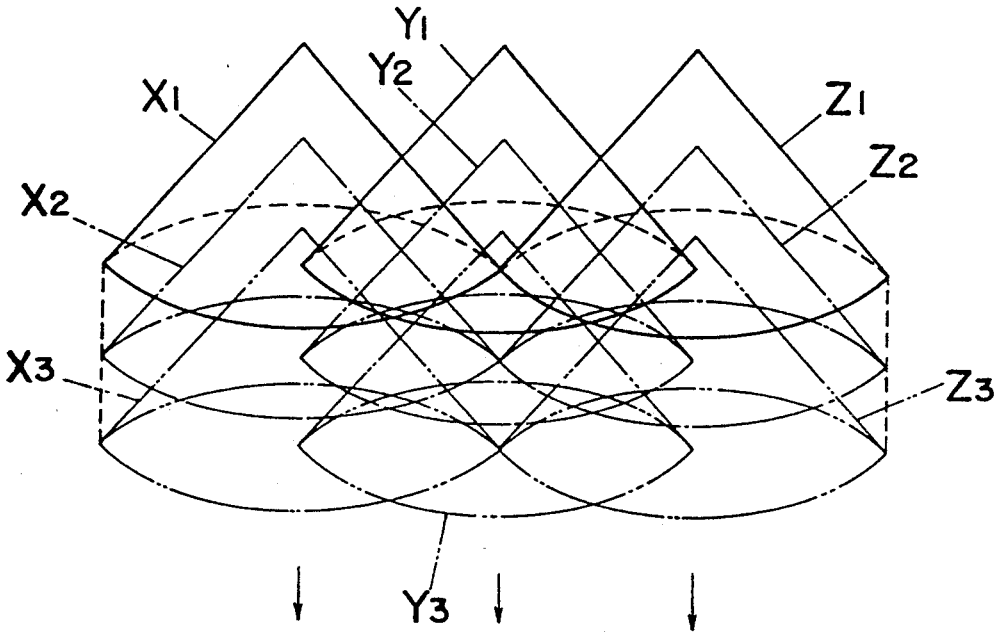
FIG. 8 is an explanatory diagram showing the stirring and mixing range for when the consolidating fluid is sprayed diagonally downward for when multiple shafts are used for the rotating shaft in the embodiment shown in FIG. 5.
Figure 9:
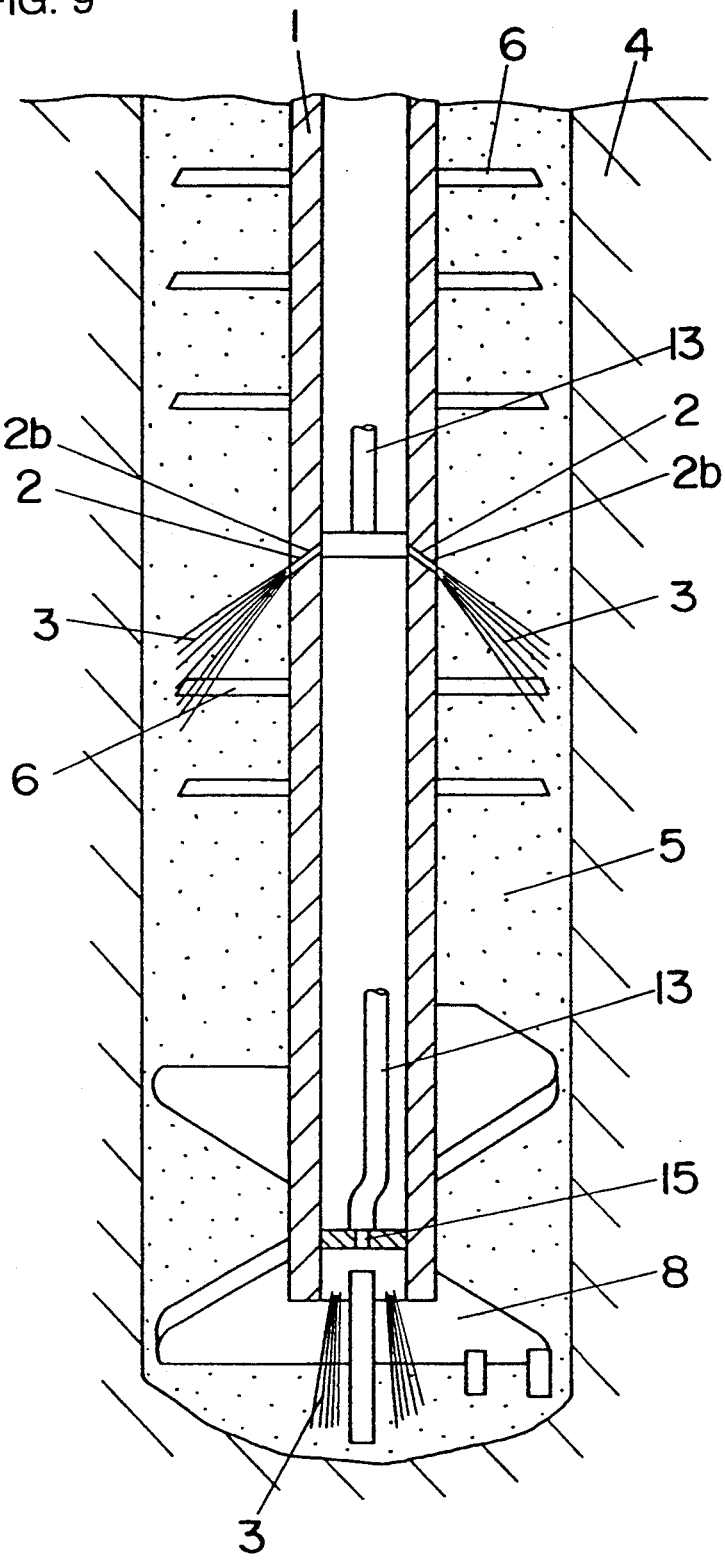
FIG. 9 is a cross-sectional view of the work-in-progress condition of yet another embodiment of this invention.

FIGS. 5, 6, 7, 8, and 9 show other embodiments of this invention. In these embodiments, the consolidating fluid spray nozzles 2 which are provided on the rotating shaft 1 and which spray the consolidating fluid 3 are comprised of consolidating fluid spray nozzles **2*b* which spray diagonally downward. Thus, by carrying out the stirring and mixing using an embodiment in which the consolidating fluid 3 is sprayed diagonally downward from the consolidating fluid spray nozzles 2*b*, because the rotating shaft 1 rotates while the consolidating fluid 3 is being sprayed diagonally downward from the consolidating fluid spray nozzles 2*b*, the consolidating fluid 3 is sprayed in an approximately conical shape and the stirring and mixing range also becomes an approximately conical shape, as shown in FIG. 7. As a result, in comparison to the circular shaped stirring and mixing range for when the rotating shaft 1 rotates while spraying horizontally, the stirring and mixing range becomes three-dimensional, thus providing more effective stirring and mixing. In particular, by spraying diagonally downward from the consolidating fluid spray nozzles 2*b* and rotating the rotating shaft 1 as the rotating shaft 1 descends, the three-dimensional (approximately conically shaped) stirring and mixing ranges X1, X2, X3 . . . shift downward as indicated by A, B, and C in FIG. 7, thus providing stirring and mixing in which the stirring and mixing ranges overlap each other three-dimensionally in the vertical direction. Furthermore, as shown in FIG. 8, for an embodiment having multiple rotating shafts 1, in addition to the three-dimensional (approximately conically shaped) stirring and mixing ranges X1, X2, X3 . . . , Y1, Y2, Y3 . . . , and Z1, Z2, Z3 . . . overlap each other three-dimensionally in the vertical direction, the three-dimensional (approximately conically shaped) stirring and mixing ranges also overlap each other three-dimensionally in the horizontal direction, thus providing effective stirring and mixing. Although stirring components 6 can be provided or not provided as needed, with an embodiment in which stirring components 6 are provided, such as that shown in FIG. 5, the mixture of soil and consolidating fluid which is stirred and mixed together while overlapping three-dimensionally as described above is further stirred by the stirring components 6, thus providing more efficient stirring and mixing. Furthermore, if, as shown in FIG. 9, the consolidating fluid spray nozzles 2*b* which spray the consolidating fluid 3 diagonally downward are provided at a position on the rotating shaft 1 above the stirring components 6, the mixture of soil and consolidating fluid will be further stirred and mixed together by the stirring components 6** at the same time that it is being stirred and mixed together by the consolidating fluid being sprayed diagonally downward, and this simultaneous complex stirring and mixing will provide even more effective stirring and mixing.

Figure 10:
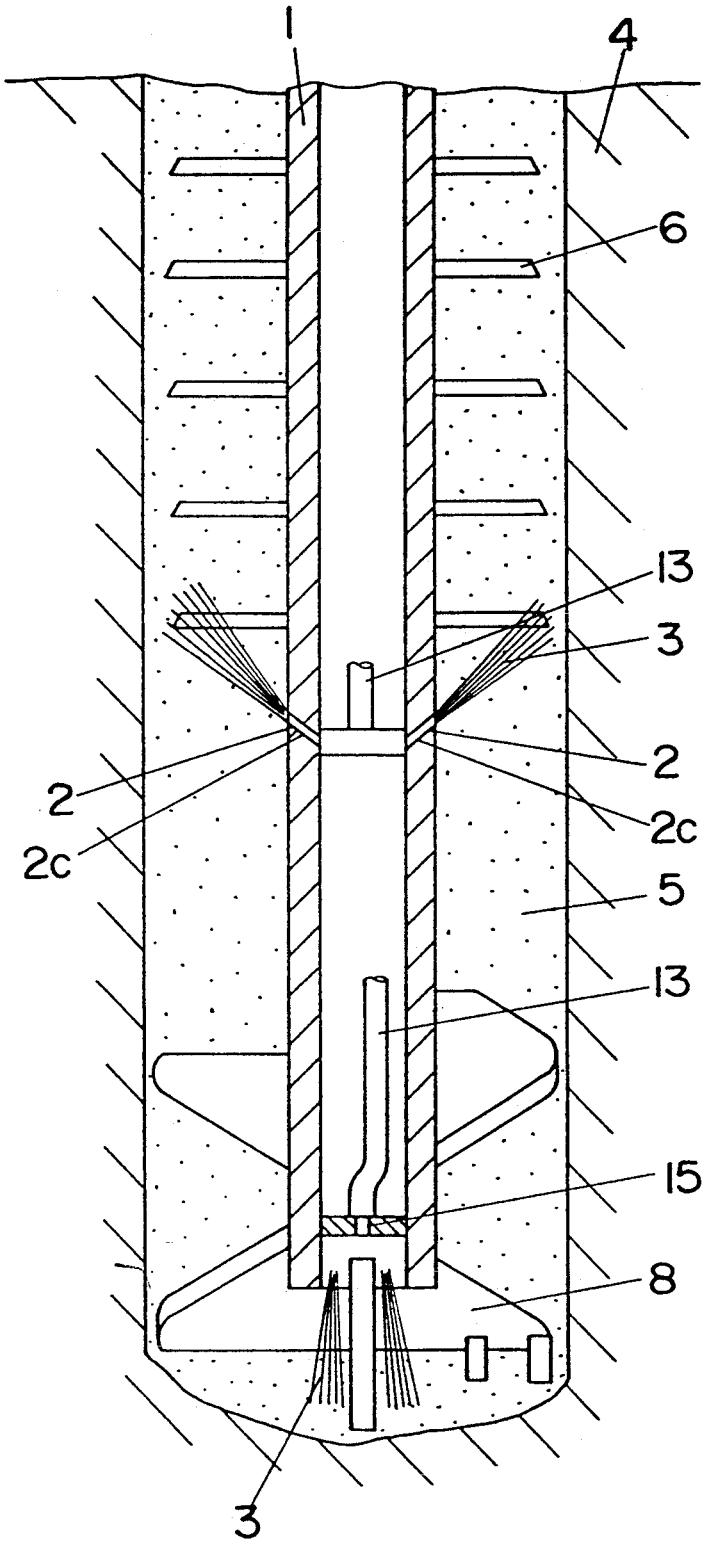
FIG. 10 is a cross-sectional view of the work-in-progress condition of yet another embodiment of this invention.
Figure 11:
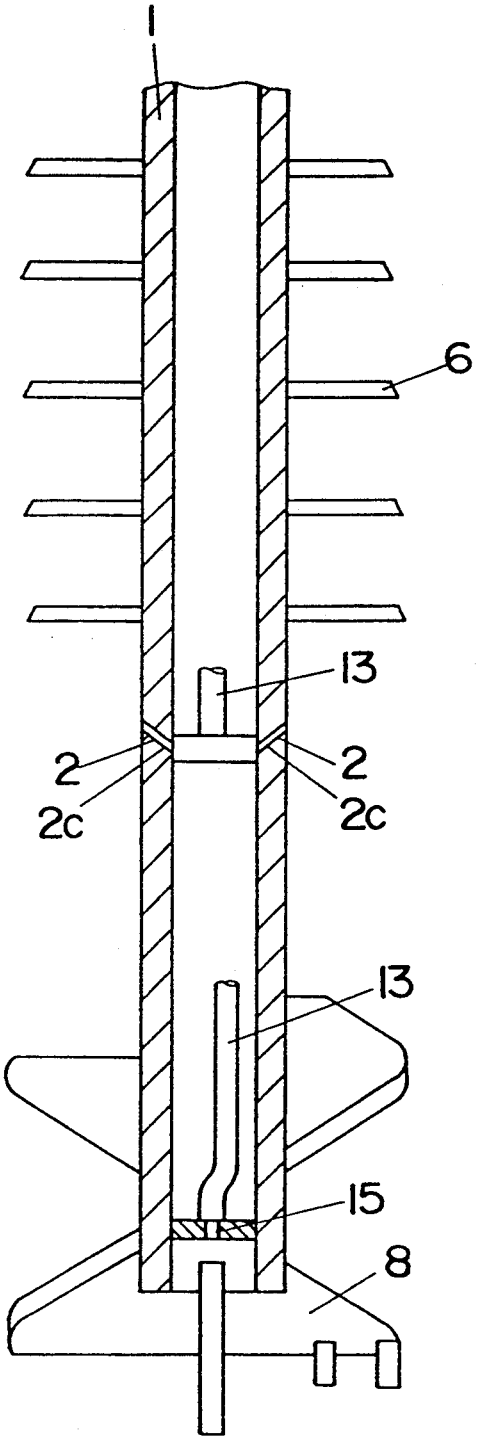
FIG. 11 is an enlarged cross-sectional view of the major components of the device used in the embodiment shown in FIG. 10.
Figure 12:
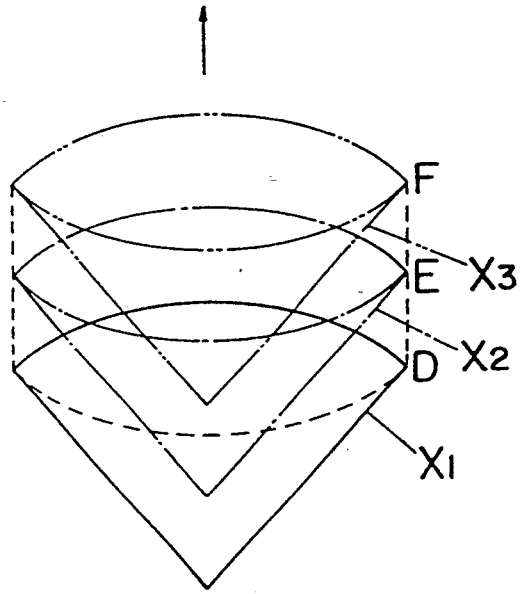
FIG. 12 is an explanatory diagram showing the stirring and mixing range for when the consolidating fluid is sprayed diagonally upward in the embodiment shown in FIG. 10.

FIGS. 10, 11, and 12 show another embodiment of this invention. In this embodiment, the consolidating fluid spray nozzles 2 which are provided on the rotating shaft 1 and which spray the consolidating fluid 3 are comprised of consolidating fluid spray nozzles **2*c* which spray diagonally upward. Thus, by carrying out the stirring and mixing using an embodiment in which the consolidating fluid 3 is sprayed diagonally upward from the consolidating fluid spray nozzles 2*c*, because the rotating shaft 1 rotates while the consolidating fluid 3 is being sprayed diagonally upward from the consolidating fluid spray nozzles 2*c*, the consolidating fluid 3 is sprayed in an approximately upside-down conical shape and the stirring and mixing range also becomes an approximately upside-down conical shape, as shown in FIG. 12. As a result, in comparison to the circular shaped stirring and mixing range for when the rotating shaft 1 rotates while spraying horizontally, the stirring and mixing range becomes three-dimensional, thus providing more effective stirring and mixing. In particular, by spraying diagonally upward from the consolidating fluid spray nozzles 2*c* and rotating the rotating shaft 1 as the rotating shaft 1 is being withdrawn, the three-dimensional (approximately conically shaped) stirring and mixing ranges X1, X2, X3 . . . shift upward as indicated by D, E, and F in FIG. 12, thus providing stirring and mixing in which the stirring and mixing ranges overlap each other three-dimensionally in the vertical direction. Although stirring components 6 can be provided or not provided as needed, with an embodiment in which stirring components 6 are provided, such as that shown in FIG. 10, the mixture of soil and consolidating fluid which is stirred and mixed together while overlapping three-dimensionally as described above is further stirred by the stirring components 6, thus providing more efficient stirring and mixing. Furthermore, if, as shown in FIG. 10, the consolidating fluid spray nozzles 2*c* which spray the consolidating fluid 3 diagonally upward are provided at a position on the rotating shaft 1 below the stirring components 6, the mixture of soil and consolidating fluid will be further stirred and mixed together by the stirring components 6** at the same time that it is being stirred and mixed together by the consolidating fluid being sprayed diagonally downward, and this simultaneous complex stirring and mixing will provide even more effective stirring and mixing.

The following is an explanation of yet another embodiment of this invention.

Figure 13:
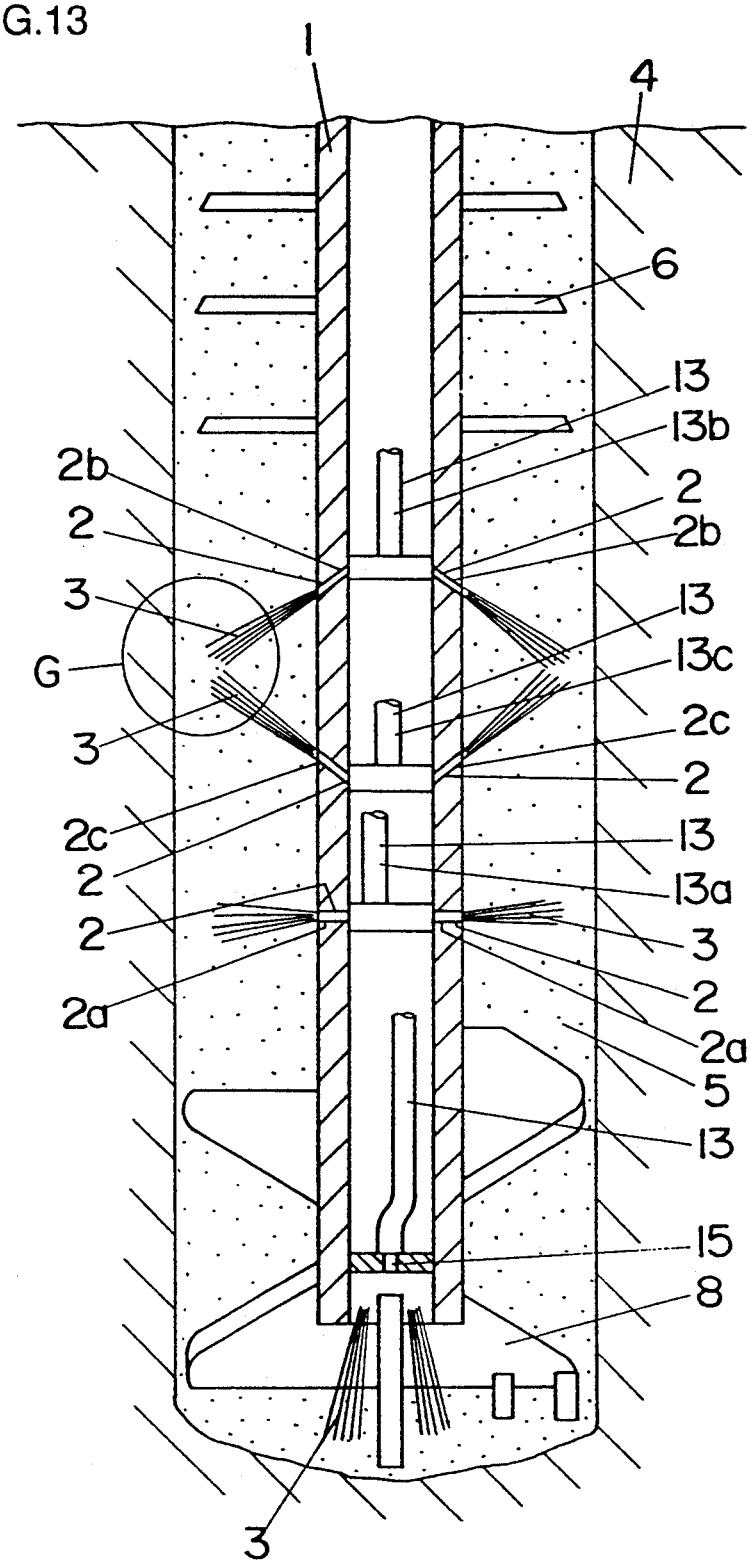
FIG. 13 is a cross-sectional view of the work-in-progress condition of yet another embodiment of this invention.
Figure 14:
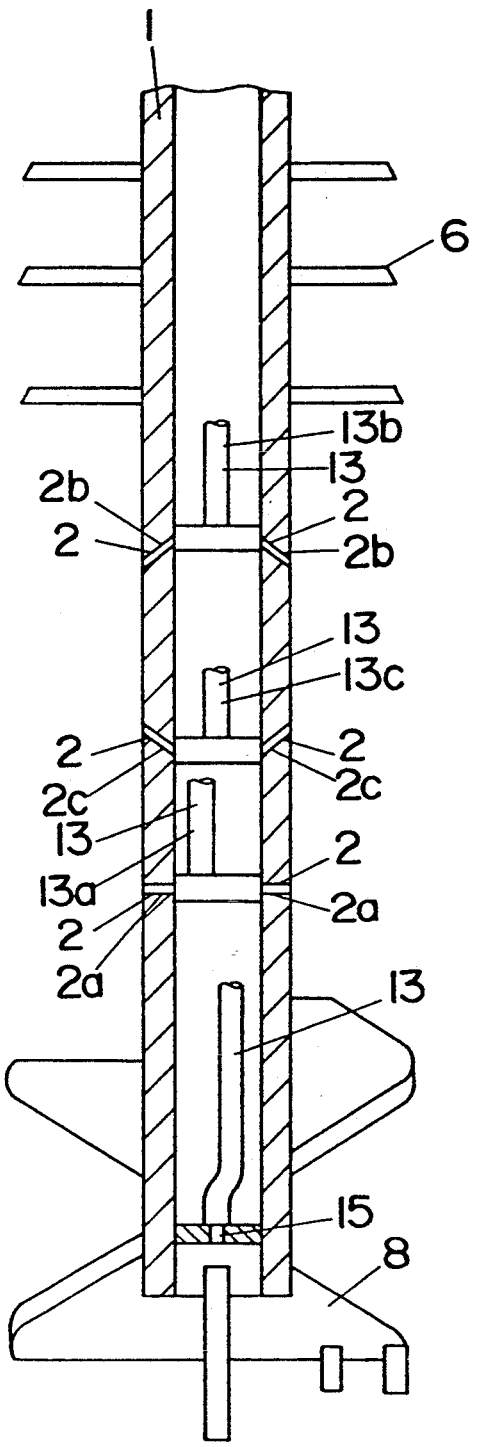
FIG. 14 is an enlarged cross-sectional view of the major components of the device used in the embodiment shown in FIG. 13.

In this embodiment, of three types of consolidating fluid spray nozzles 2 which spray the consolidating fluid 3, consolidating fluid spray nozzles **2*a* which spray the consolidating fluid 3 horizontally, consolidating fluid spray nozzles 2*b* which spray the consolidating fluid 3 diagonally downward, and consolidating fluid spray nozzles 2*c* which spray the consolidating fluid 3 diagonally upward, and least two types are provided on the rotating shaft 1, and FIGS. 13 and 14 show an example in which all three types of consolidating fluid spray nozzles 2***a*, 2*b*, and 2*c*, each with a different spray direction, are provided on the rotating shaft 1. In this embodiment, consolidating fluid supply hoses 13*a*, 13*b*, and 13*c* are respectively connected to each of the consolidating fluid spray nozzles 2*a*, 2*b*, and 2*c*, thus making it possible to independently supply or not supply the consolidating fluid 3 to be sprayed from each of the consolidating fluid spray nozzles 2*a*, 2*b*, and 2*c*. Thus, with this embodiment, it is possible to spray the consolidating fluid 3 from all of the consolidating fluid spray nozzles 2*a*, 2*b*, and 2*c*, or from any two types, or from any one type, in accordance with the conditions of the earthen foundation 4 and other conditions such as during the descent or ascent of the rotating shaft 1. By doing this, as already explained, it is of course possible to expect greater operating effectiveness from the consolidating fluid 3 sprayed from each of the consolidating fluid spray nozzles 2*a*, 2*b*, and 2*c*. In particular, one method of operation would be, during the descent of the rotating shaft 1, to stir and mix while spraying consolidating fluid 3 diagonally downward from the consolidating fluid spray nozzles 2*b* and, as needed, to also stir and mix while spraying consolidating fluid approximately horizontally from the consolidating fluid spray nozzles 2*a*, and then, during the ascent and withdrawal of the rotating shaft 1, to stir and mix while spraying consolidating fluid 3 diagonally upward from the consolidating fluid spray nozzles 2*c* and again, as needed, to also stir and mix while spraying consolidating fluid approximately horizontally from the consolidating fluid spray nozzles 2*a*. However, the operation possibilities are not necessarily be limited to this example. In addition, in situations where the soil of the earthen foundation 4 was soft (clayish soil in which the moisture content exceeds 100%), it is also possible to stir and mix by spraying the consolidating fluid 3 approximately horizontally from the consolidating fluid spray nozzles 2*a*. In particular, when the consolidating fluid 3 being sprayed from consolidating fluid spray nozzles 2*a* or consolidating fluid spray nozzles 2*b* or consolidating fluid spray nozzles 2*c* intersects as indicated at G in FIG. 13, consolidating fluids 3 having different spray directions collide with each other, thus providing even more effective stirring and mixing. When two or more types of consolidating fluid spray nozzles 2*a*, 2*b*, and 2*c* are provided on the rotating shaft 1, the placement positions in the vertical direction can be selected arbitrarily. In addition, in order to have consolidating fluids 3 which have different spray directions intersect and collide with each other as described above, rather than being limited to the placement positions shown in FIG. 13, various placement combination patterns can be obtained by placing the two or more types of consolidating fluid spray nozzles 2*a*, 2*b*, and 2*c* in arbitrary positions in the vertical direction. Of course, in this embodiment as well, it is possible to either provide or not provide stirring components 6.

Figure 15:
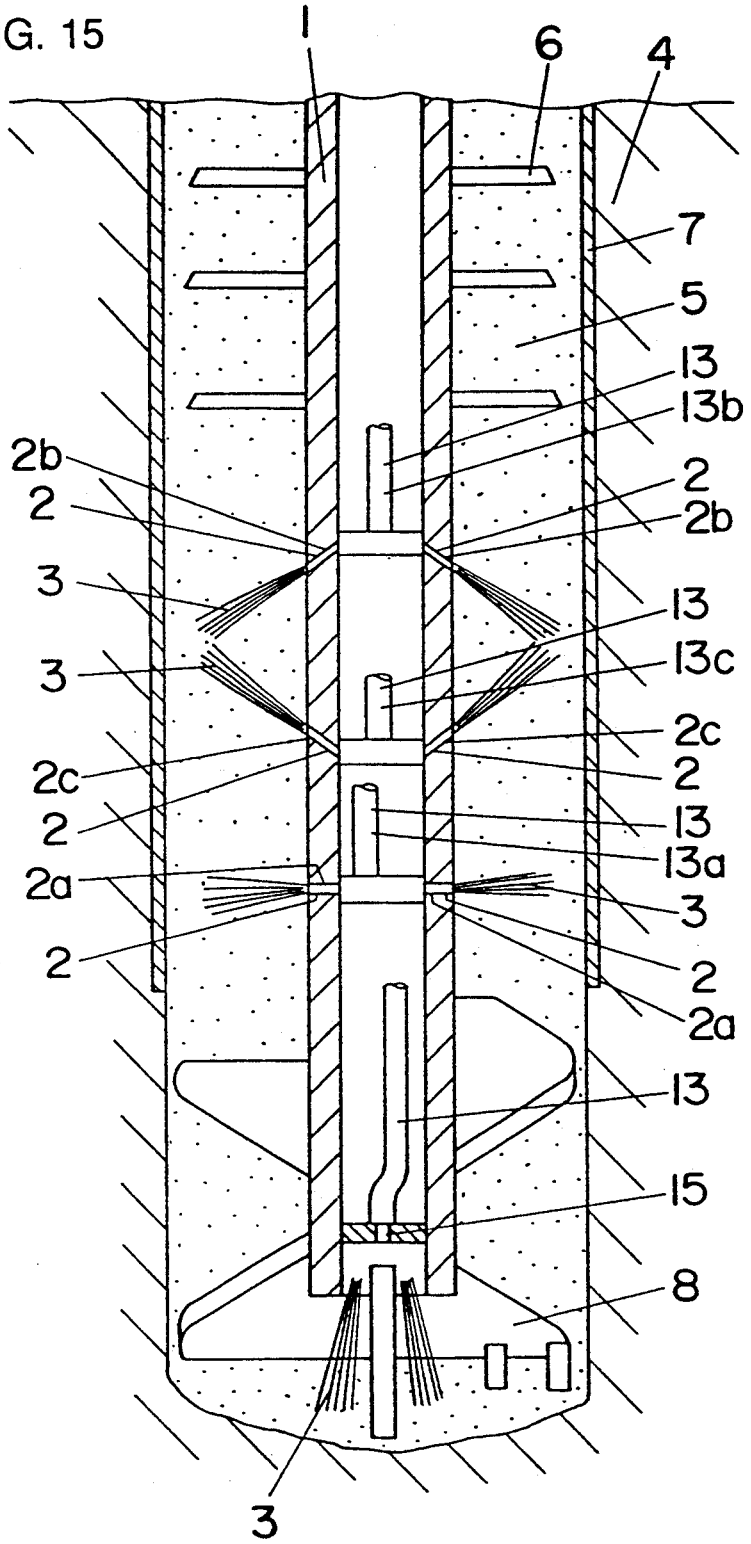
FIG. 15 is a cross-sectional view of the work-in-progress condition of yet another embodiment of this invention.

Next, the following is an explanation of yet another embodiment of this invention based on FIG. 15.

In this embodiment, the rotating shaft 1 is positioned inside a casing tube 7, this casing tube 7 simultaneously penetrates the earthen foundation 4 together with the rotating shaft 1, and the soil of the original foundation and the consolidating fluid 3 are stirred and mixed together inside the casing tube 7. In this embodiment, for the consolidating fluid spray nozzles 2 which spray the consolidating fluid 3, although consolidating fluid spray nozzles 2*a* which spray the consolidating fluid 3 horizontally, consolidating fluid spray nozzles 2*b* which spray the consolidating fluid 3 diagonally downward, and consolidating fluid spray nozzles 2*c* which spray the consolidating fluid 3 diagonally upward are all provided in the example shown, it is also possible to provide only consolidating fluid spray nozzles 2*a* which spray the consolidating fluid 3 horizontally, or to provide only consolidating fluid spray nozzles 2*b* which spray the consolidating fluid 3 diagonally downward, or to provide only consolidating fluid spray nozzles 2*c* which spray the consolidating fluid 3 diagonally upward, or to provide any two types of these consolidating fluid spray nozzles 2*a*, 2*b*, and 2*c* as the consolidating fluid spray nozzles 2 which spray the consolidating fluid 3. Also, in this embodiment, the consolidating fluid 3 sprayed from the consolidating fluid spray nozzles 2 strikes forcefully against the inner wall of the casing tube 7, providing additional fine shearing action and stirring and mixing, and thus achieving high-quality foundation improvement. In addition, with this embodiment, even though the consolidating fluid 3 from the consolidating fluid spray nozzles 2 provided on the rotating shaft 1 is sprayed approximately horizontally, or diagonally downward, or diagonally upward, a pillar having the same diameter as the casing tube 7 can be accurately formed without the surrounding earthen foundations being damaged by the spraying of the consolidating fluid, and, in addition, because there is no damage or breaking apart of the surrounding earthen foundation, it is possible to form a strong, high-quality pillar exactly as designed. In this embodiment as well, it is possible to either provide on not provide stirring components 6 as needed.

It should be noted that this invention is not limited to embodiments having multiple rotating shafts 1, but can also of course be one having a single rotating shaft.

As explained above, with this invention, because consolidating fluid spray nozzles which spray the consolidating fluid approximately horizontally are provided on the rotating shaft, and because the pillar is formed in the earthen foundation by stirring and mixing together the consolidating fluid and the excavated soil of the original foundation in such a way that the rotating speed of the rotating shaft is faster for clayish soil than for sandy soil, the pressure from the consolidating fluid spray nozzles is higher for clayish soil than for sandy soil, and the penetration speed of the rotating shaft is slower for clayish soil than for sandy soil, it has the advantage that the soil of the original foundation is finely sheared and effectively stirred and mixed by the consolidating fluid sprayed approximately horizontally, and, in addition, it also has the advantage that a high-quality foundation-improvement pillar can be formed in the earthen foundation by the most efficient method in accordance with whether the soil is clayish or sandy.

In addition, with an embodiment in which consolidating fluid spray nozzles which spray the consolidating fluid diagonally downward are provided on the rotating shaft, and in which the pillar is formed in the earthen foundation by stirring and mixing together the consolidating fluid and the excavated soil of the original foundation in such a way that the rotating speed of the rotating shaft is faster for clayish soil than for sandy soil, the pressure from the consolidating fluid spray nozzles is higher for clayish soil than for sandy soil, and the penetration speed of the rotating shaft is slower for clayish soil than for sandy soil, in addition to the advantage of it being possible to form a high-quality foundation-improvement pillar in the earthen foundation by the most efficient method in accordance with whether the soil is clayish or sandy, because the consolidating fluid is sprayed diagonally downward while the rotating shaft is rotating, the stirring and mixing range for one rotation of the rotating shaft becomes an approximately conical shape, thus enlarging the stirring and mixing range, and, in particular, by stirring and mixing while spraying diagonally downward during the descent of the rotating shaft, this approximately conically shaped stirring and mixing range overlaps as it moves downward, thus providing the advantage of even more efficient stirring and mixing.

In addition, with an embodiment in which consolidating fluid spray nozzles which spray the consolidating fluid diagonally upward are provided on the rotating shaft, and in which the pillar is formed in the earthen foundation by stirring and mixing together the consolidating fluid and the excavated soil of the original foundation in such a way that the rotating speed of the rotating shaft is faster for clayish soil than for sandy soil, the pressure from the consolidating fluid spray nozzles is higher for clayish soil than for sandy soil, and the penetration speed of the rotating shaft is slower for clayish soil than for sandy soil, in addition to the advantage of it being possible to form a high-quality foundation-improvement pillar in the earthen foundation by the most efficient method in accordance with whether the soil is clayish or sandy, because the consolidating fluid is sprayed diagonally upward while the rotating shaft is rotating, the stirring and mixing range for one rotation of the rotating shaft becomes an approximately upside-down conical shape, thus enlarging the stirring and mixing range, and, in particular, by stirring and mixing while spraying diagonally upward during the ascent of the rotating shaft, this approximately upside-down conically shaped stirring and mixing range overlaps as it moves upward, thus providing the advantage of even more efficient stirring and mixing.

In addition, with an embodiment in which consolidating fluid spray nozzles which spray consolidating fluid diagonally downward, consolidating fluid spray nozzles which spray consolidating fluid approximately horizontally, and consolidating fluid spray nozzles which spray consolidating fluid diagonally upward are provided on the rotating shaft, and in which the pillar is formed in the earthen foundation by stirring and mixing together the consolidating fluid and the excavated soil of the original foundation in such a way that the rotating speed of the rotating shaft is faster for clayish soil than for sandy soil, the pressure from the consolidating fluid spray nozzles is higher for clayish soil than for sandy soil, and the penetration speed of the rotating shaft is slower for clayish soil than for sandy soil, in addition to the advantage of it being possible to form a high-quality foundation-improvement pillar in the earthen foundation by the most efficient method in accordance with whether the soil is clayish or sandy, it is also possible to select the spray direction of the consolidating fluid in accordance with the type of soil and the descent and ascent of the rotating shaft, thus providing the most efficient stirring and mixing.

In addition, by providing stirring components on the rotating shaft, the stirring and mixing together of the soil of the original foundation and the consolidating fluid are accomplished more efficiently.

In addition, with an embodiment in which the rotating shaft is positioned inside a casing tube and the stirring and mixing together of the soil of the original foundation and the consolidating fluid are accomplished inside the casing tube, damage to the surrounding earthen foundation by the spraying of the consolidating fluid can be prevented by the casing tube and a high-quality foundation-improvement pillar having the same diameter as the casing tube can be formed, and, in addition, because the consolidating fluid sprayed from the consolidating fluid spray nozzles, together with the soil of the original foundation, strikes forcefully against the inner wall of the casing tube, the stirring and mixing together of the soil of the original foundation and the consolidating fluid are accomplished more effectively.

In addition, by setting the rotating speed of the rotating shaft to approximately 40 to 70 revolutions per minute for clayish soil and to approximately 25 to 40 revolutions per minute for sandy soil, setting the spray pressure from the consolidating fluid spray nozzles 2 to approximately 100 to 500 kg/cm$^2$ for clayish soil and to approximately 50 to 100 kg/cm$^2$ for sandy soil, and setting the penetration speed of the rotating shaft 1 to approximately 1 meter per minute for clayish soil and to approximately 2 meters per minute for clayish soil, the most effective stirring and mixing together of the soil of the original foundation and the consolidating fluid are accomplished in accordance with the conditions of the earthen foundation.

What is claimed is:

1. A method for forming a pillar in an earthen foundation comprising:

excavating the earthen foundation with a bit provided on a lower end of a rotating shaft, while jetting a consolidating fluid downwardly from a bottom nozzle of the bit; and stirring and mixing an excavated soil of the earthen foundation with said consolidating fluid jetted in a direction including at least one diagonal direction from side nozzles provided in said rotating shaft and spaced upwardly of the bit;

wherein a rotating speed of said rotating shaft is made faster for clayish soil than for sandy soil, a pressure of said consolidating fluid from said side nozzles is made higher for the clayish soil than for the sandy soil, and a penetration speed of said rotating shaft is made slower for the clayish soil than for the sandy soil.

2. A method as set forth in claim 1, wherein said side nozzles are provided in said rotating shaft for jetting said consolidating fluid in a downwardly diagonal direction therefrom.

3. A method as set forth in claim 1, wherein said side nozzles are provided in said rotating shaft for jetting consolidating fluid in an upwardly diagonal direction therefrom.

4. A method as set forth in claim 1, wherein said side nozzles include at least two types selected from the group consisting of a first nozzle for jetting said consolidating fluid in a downwardly diagonal direction, a second nozzle for jetting said consolidating fluid in an upwardly diagonal direction and a third nozzle for jetting said consolidating fluid in the horizontal direction perpendicular to said rotating shaft.

5. A method as set forth in claim 4, wherein said consolidating fluid can be jetted selectively from said side nozzles.

6. A method as set forth in claim 4, wherein said side nozzles are provided in said rotating shaft such that said consolidating fluid jetted from one type of said side nozzles collides with said consolidating fluid jetted from another type thereof.

7. A method as set forth in claim 1, wherein stirring is performed by stirring components provided on said rotating shaft.

8. A method as set forth in claim 7, wherein said stirring components and aid side nozzles are provided in said rotating shaft in such a manner said consolidating fluid jetted in a downwardly diagonal direction from said side nozzles collides with the stirring components.

9. A method as set forth in claim 7, wherein said stirring components are provided on said rotating shaft in such a manner that said consolidating fluid jetted in an upwardly diagonal direction from said side nozzles collides with said stirring components.

10. A method as set forth in claim 1, wherein said rotating shaft is positioned inside a casing tube so that the excavated soil and said consolidating fluid are stirred and mixed together inside said casing tube.

11. A method as set forth in claim 1, wherein the rotating speed of said rotating shaft is set to approximately 40 to 70 revolutions per minute for the clayish soil and to approximately 25 to 40 revolutions per minute for the sandy soil, the pressure of said consolidating fluid from said side nozzles is set to approximately 100 to 500 $kg/cm^2$ for the clayish soil and to approximately 50 to 100 $kg/cm^2$ for the sandy soil, and the penetration speed of said rotating shaft is set to approximately 1 meter per minute for the clayish soil and to approximately 2 meters per minute for the sandy soil.

* * * * *